United States Patent [19]

Neugart

[11] 4,013,397

[45] Mar. 22, 1977

[54] COMBUSTION APPARATUS

[76] Inventor: Fernando M. Neugart, 32-21 37th St., Astoria, N.Y. 11102

[22] Filed: Dec. 5, 1975

[21] Appl. No.: 637,872

[52] U.S. Cl. ..... 431/291; 431/289; 431/298; 431/320

[51] Int. Cl.[2] ..... F23D 3/16; F23D 3/24

[58] Field of Search ..... 431/291, 293, 289, 298, 431/320

[56] References Cited

UNITED STATES PATENTS

| | | | |
|---|---|---|---|
| 1,184,511 | 5/1916 | Bourgeois | 431/291 X |

FOREIGN PATENTS OR APPLICATIONS

| | | | |
|---|---|---|---|
| 1,090,606 | 10/1960 | Germany | 431/298 |
| 542,948 | 2/1942 | United Kingdom | 431/298 |

*Primary Examiner*—Irwin C. Cohen

*Attorney, Agent, or Firm*—Mark T. Basseches; Paula T. Basseches

[57] ABSTRACT

The present invention is directed to a combustion apparatus particularly intended for use with fuels which are solid at normal ambient temperatures but are readily meltable at temperatures somewhat exceeding ambient, the fuels being combustible in their molten state. An example of a preferred form of fuel is paraffin.

The apparatus preferably includes a two part plate assembly adapted to float upon molten fuel, the plate assembly being centrally apertured and provided with a wick extending through the aperture, the heat developed by combustion by the wick being transmitted through the conductive plate assembly to heat and thereby melt a supply of fuel directly below the assembly.

6 Claims, 3 Drawing Figures

COMBUSTION APPARATUS

BACKGROUND OF THE INVENTION

1. Field of the Invention

The present invention is directed to combustion devices in the nature of a candle.

2. The Prior Art

As is well known, conventional candles embody paraffin or a like sold, meltable fuel having a wick extending therethrough. When the wick is lighted, paraffin immediately adjacent the flame area is melted and absorbed by the wick, combustion of the paraffin taking place at the upper end of the wick.

It is further known to provide a so-called oil candle wherein a cork or like annulus is formed with a central aperture supporting a wick extending through the aperture. When the cork floats on the surface of the liquid, the lower end of the wick is dipped into the oil and the upper end of the wick is lighted, whereby progressive combustion occurs.

Heretofore no known combustion apparatus has permitted the burning of a solid fuel without the fuel having been previously provided with an internal wick.

SUMMARY

The present invention may be summarized as directed to a combustion apparatus adapted to be used with a mass of solid fuel, such as paraffin, which is not provided with an internal wick and/or to provide an improved and safer burning characteristic when used with a conventional candle formed within a vessel. The apparatus includes a floatable, heat conductive plate incorporating a central aperture surrounding a heat collector rim. Thermally conductive means are provided for supporting a wick in the aperture, with portions of the wick extending below the bottom of the plate and with an upper portion of the wick disposed immediately adjacent the rim.

When the wick is lighted, heat generated by the flame is transmitted to the wick holder and heat collector rim surrounding the aperture, and thence to the plate, whereby the solid fuel below the plate is melted and the apparatus floats on a pool of molten fuel.

The apparatus includes a cover plate of a size essentially indentical with the bottom plate, the cover plate being preferably spaced from the bottom plate, the plates defining therebetween a hollow, dead air enclosing compartment which functions as an insulator, preventing dissipation of heat from the bottom plate, whereby the heat transmitted to the heat collector rim and thence to the flat bottom of the apparatus is most advantageously and efficiently used to melt the solid fuel material beneath the apparatus.

It should be understood that the wick for the instant apparatus is preferably provided by a short wick section extending through the aperture and maintained in position by a wick holder, it being further understood that in accordance with an embodiment of the invention, an existing and conventional wick embodied within a solid fuel in a container may be utilized by passing the same upwardly through the aperture.

In the latter utilization, the wick is maintained in centralized position within the vessel containing the solid fuel, and combustion adjacent the edge of the vessel, with consequent possible fracturing of the container vessel, is positively prevented.

Accordingly, it is an object of the invention to provide a combustion apparatus adapted to permit the formation of a candle-like flame, utilizing a low temperature, meltable, solid fuel material, such as paraffin, certain fats, etc.

A further object of the invention is the provision of a combustion apparatus comprising a floatable plate member having a high thermal conductivity factor, the plate member functioning to support or position a wick and, as a result of heat generated by the fuel being consumed, to melt still other portions of fuel directly below the floatable plate, whereby a constant supply of liquid fuel is assured.

Still a further object of the invention is the provision of a device of the type described and including a cover plate mounted over the bottom plate, the cover plate being spaced from the bottom plate to define an insulating compartment whereby heat transferred to the bottom plate by the flame is most efficiently employed in melting additional solid fuel rather than being dissipated by conduction, convection or radiation to an extent that would otherwise occur if no cover plate were employed.

To attain these objects and such further objects as may appear herein or be hereinafter pointed out, reference is made to the accompanying drawings, forming a part hereof, in which.

Figure 1:
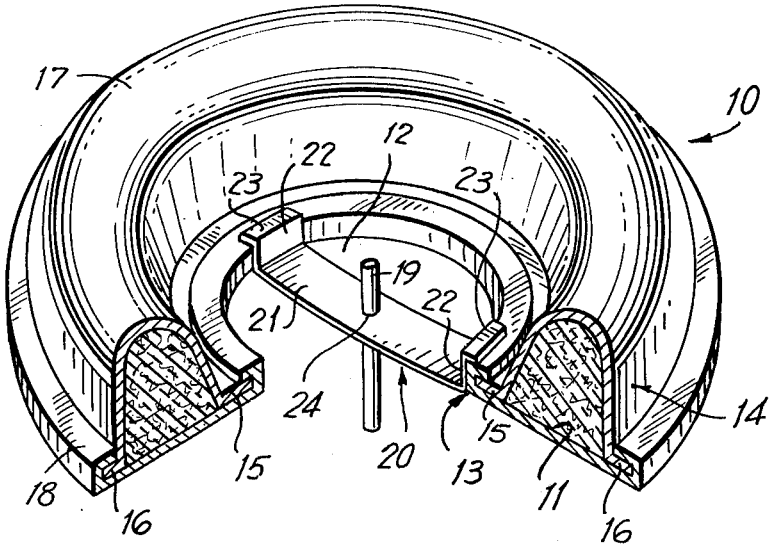
FIG. 1 is a perspective view of a combustion apparatus in accordance with the invention, with parts cut away to show details of construction.

Referring now to the drawings, in FIG. 1 the combustion apparatus 10 includes a conductor plate member 11 which is formed of metal having a high thermal conductivity factor. Most metals are suitable, aluminum, steel, copper, brass being mentioned by way of example.

The conductor plate member 11 includes a central aperture portion 12 of about ½ to ¾ inch diameter, the aperture portion 12 being defined by an integral heat collector rim 13. An upper plate member 14 includes an innermost annular flange 15 defining an aperture, an outwardly extending perimetric flange 16 and a central raised portion 17.

Preferably, the plates 11 and 14 are connected interiorly by the heat collector rim 13 being rolled outwardly over the flange 15. Connection between the outer perimetric flange 16 and the outermost portions of the plate 11 is preferably formed by rolling the raised perimetric portion 18 of the plate 11 inwardly over the flange 16 of the upper plate 14.

Figure 2:
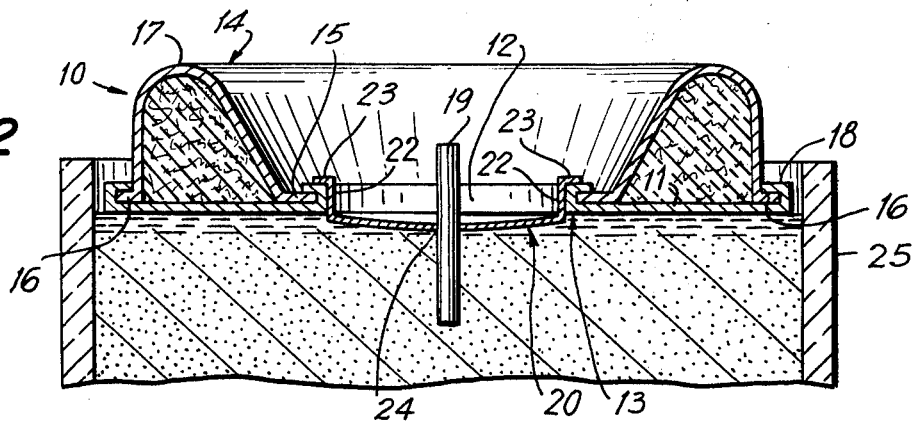
FIG. 2 is a section taken on the line 2—2 of FIG. 1.

The embodiment of FIGS. 1 and 2 is intended to be used with a solid fuel contained in a vertically oriented vessel, the inner walls 25 of which correspond closely to the perimeter of the apparatus, to permit vertical passage of the apparatus within the container or vessel. As will be appreciated, the container which is preferably used would be cylindrical.

A short wick section 19 of glass wool, asbestos, cotton or the like is supported within the aperture 12 by a wick holder member 20. The wick holder preferably comprises a generally U-shaped member including a central branch 21 and vertically extending legs 22, 22, the noted legs having outwardly directed shoulders 23, 23 at their upper ends.

The wick holder 20 is formed of a springy metal and is simply flexed into the position shown in FIGS. 1 and 2, whereat it is maintained by friction.

The wick 19 is mounted within an aperture 24 formed in the bridge or branch 21 of the wick holder. The wick 19 may be maintained in position within the aperture as a result of frictional fit or, alternatively, the aperture 24 may be slightly over-sized as respects the diameter of the wick 19, permitting easy insertion of the wick, the dimension of the wick holder being such as to bend the bridge portion 21 of the same to a slight degree when inserted into the aperture 12, slight bending reducing the effective cross sectional dimension of the aperture 24, holding the wick in the aperture when the wick holder is frictionally retained in the float mechanism.

The operation of the apparatus will be apparent from the preceding description.

The article is placed within a vessel having side walls 25 which preferably provide slight clearance with respect to the perimeter of the float member. The wick 19. which is originally saturated with paraffin or like flammable material, is lighted. Optionally a small piece of paraffin is placed on the wick holder above and adjacent the wick holding aperture. Heat from the flame is transmitted to the heat collector rim 13 and the thermally conductive wick holder member 20. The heat melts the paraffin components directly below the wick 19, providing a fresh supply of liquid fuel which may travel up the wick for continued combustion.

The heat is likewise transferred laterally through the conductor plate 11, and the paraffin material beneath the entirety of the plate will be melted, whereby the plate floats on a shallow pool of molten paraffin, it being understood that as progressive increments of the paraffin are burnt, the apparatus will sink lower and lower within the vessel.

The dead air entrapped between the cover plate 17 and the conductor plate 11 assures minimal waste of heat, e.g. assures that the heat transmitted to the conductor plate is used to melt additional paraffin rather than being dissipated through the effects of conduction, convection, and radiation from the plate 11.

Optionally, and for even more efficient utilization of the generated heat, increments of glass wool, asbestos and the like light weight thermal insulating materials may be packed into the void between the two plates.

The embodiment of FIG. 3 operates on essentially the same basis as hereinabove set forth except that the device is used with a conventional candle assembly having a glass vessel filled with paraffin and having a wick cast therein.

Figure 3:
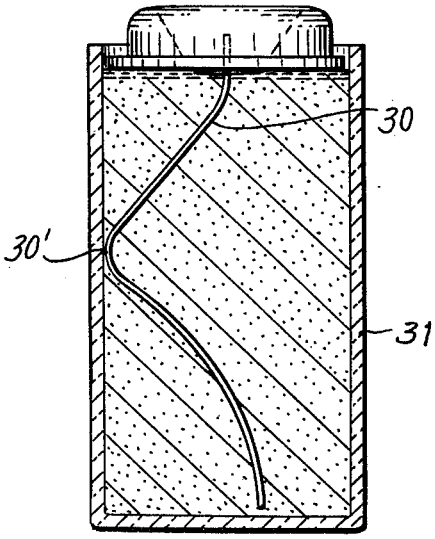
FIG. 3 is a cross sectional view of the device used to burn fuel within a vessel having a wick formed therein.

In the embodiment of FIG. 3, the wick holder and wick assembly have been removed and the wick 30 of the candle has been led out through the aperture 24.

The purpose of utilizing the apparatus in an assembly having an integral wick is to avoid the frequently encountered situation where the wick is improperly placed within the vessel 31, e.g. in the area 30', and lies unduly close to a side wall of the vessel. If the candle assembly of FIG. 3 were burnt without using the apparatus, it would be evident that the flame of the candle when the wick reached the level 30' would closely approach the side walls of the vessel. Since the containing vessel is often formed of glass, the close approach of the flame might result in cracking the vessel and consequent leakage of the molten paraffin.

The use of the apparatus assures that the wick is guided centrally within the vessel and, thus, the fire hazard inherent in burning candles with improperly positioned wicks, such as shown in FIG. 3, is eliminated.

A further feature of the device is that, by virtue of the buoyancy provided through the use of a double plate construction, the unit may be used as an oil candle, e.g. may be floated on a non-volatile liquid fuel.

Having thus described the invention and illustrated its use, what is claimed as new and is desired to be secured by Letters Patent is:

1. A combustion apparatus for use with a fuel such as a low temperature, meltable, solid fuel, comprising in combination, a conductor plate formed of metal and having a high thermal conductivity factor, said plate including a central aperture extending transversely therethrough, said plate including a substantially flat bottom portion, an outer perimeter portion, and an integral heat collector rim extending upwardly from the upper surface of said plate surrounding said aperture, wick means extending through said aperture and including an upper end in adjacent proximate open spaced relation to said heat collector rim and said plate bottom and a lower end disposed beneath said bottom surface of said plate, wick holder means mounted in said aperture of said conductor plate for holding said wick means, and a centrally apertured cover plate member, means securing said cover plate member to said conductor plate in overlying relation to the upper surface of said conductor plate with the aperture of said cover plate surrounding said rim, portions of the under surface of said cover plate being spaced from the upper surface of said conductor plate, thereby to form a closed hollow insulating compartment between said plates.

2. Apparatus in accordance with claim 1 wherein said wick holder member is formed of thermally conductive metal.

3. Apparatus in accordance with claim 1 wherein said outer perimeter portion of said conductor plate extends upwardly from the surface of said plate and outwardly laps the periphery of said cover plate forming a part of said securing means.

4. Apparatus in accordance with claim 3 wherein said hollow insulating compartment between said plates is filled with a low density, non-flammable material such as glass wool.

5. Apparatus in accordance with claim 1 wherein said collector rim of said conductor plate extends upwardly through and is lapped over said central aperture of said cover plate forming a part of said securing means thereby to maintain said plates in interconnected relation.

6. Apparatus in accordance with claim 5 wherein the outer perimeter portion of said conductor plate includes an upwardly extending portion outwardly lapping and crimped over the upper surface of said cover plate forming a part of said securing means.

* * * * *